United States Patent [19]

Paslay

[11] 3,943,870

[45] Mar. 16, 1976

[54] PINGING CONTROLLED ANTI-TORPEDO DEVICE

[75] Inventor: LeRoy C. Paslay, Dallas, Tex.

[73] Assignee: The United States of America as represented by the Secretary of the Navy, Washington, D.C.

[22] Filed: Oct. 24, 1950

[21] Appl. No.: 191,908

[52] U.S. Cl. ..... 114/20 R; 89/41 D; 89/41 E; 89/41 AA; 114/240 R; 340/3 R

[51] Int. Cl.[2] ..... F42B 19/00

[58] Field of Search ..... 114/20, 240; 89/376; 340/3

[56] References Cited

UNITED STATES PATENTS

| | | | |
|---|---|---|---|
| 969,614 | 9/1910 | Florenz | 89/41.8 |
| 1,195,042 | 8/1916 | Leon | 114/240.1 |
| 1,897,282 | 2/1933 | Steinle | 89/37 |
| 2,368,953 | 2/1945 | Walsh | 89/41.7 |
| 2,405,694 | 8/1946 | Herzmark | 89/41.7 S |
| 2,431,854 | 12/1947 | Wood | 340/3 |
| 2,481,910 | 9/1949 | D'Ardenne | 89/1.7 B |
| 2,504,118 | 4/1950 | Evans | 89/41.7 S |
| 2,621,243 | 12/1952 | Sunstein | 340/3 |
| 2,724,817 | 11/1955 | Hisserich | 340/3 |
| 2,743,438 | 4/1956 | Page | 343/9 |
| 2,791,756 | 5/1957 | Wood et al. | 340/3 |
| 2,821,694 | 1/1958 | Sebring | 340/3 |

FOREIGN PATENTS OR APPLICATIONS

| | | | |
|---|---|---|---|
| 100,691 | 6/1916 | United Kingdom | 114/240 |
| 546,202 | 7/1942 | United Kingdom | 89/41.7 |
| 548,550 | 10/1942 | United Kingdom | 89/41.7 |

*Primary Examiner*—S. Feinberg

EXEMPLARY CLAIM

1. A system of the character disclosed for protecting a vessel against torpedo attack comprising a gimbals mechanism including an outer ring pivotally secured to said vessel and an inner ring pivotally secured to the outer ring with the axis of oscillation of the inner ring arranged in a horizontal plane, a pendulum device secured to said inner ring and having the axis of oscillation thereof arranged in registry with a vertical plane through the keel of the vessel when the vessel is on an even keel, a plurality of rocket tubes, means for securing said rocket tubes to said pendulum device in spaced relation with respect to each other and with the longitudinal axes of the tubes arranged at the same predetermined elevation when the vessel is on an even keel whereby rockets projected from said tubes will have substantially the same predetermined fixed range as the vessel rolls and pitches, said rocket tubes also having a divergent angular setting with respect to each other such that rockets projected therefrom will strike the surface of the water to form an overlapping explosive pattern at said predetermined fixed range of sufficient explosive force to destroy an oncoming torpedo within said pattern when the rockets are detonated, a directional sound emitting and echo detecting means arranged on the vessel with the field of sound emission and detection thereof projecting outwardly from the side of the vessel, said emitting and detecting means emitting sound signals into the water in the path of travel of said oncoming torpedo and thereafter receiving the reflected signals therefrom, heterodyne means for beating the reflected sound signals with the emitted sound signals to derive differential frequency signals representative of the speed of the oncoming torpedo, filter means responsive to the output of said heterodyne means for passing only differential frequency signals representative of a predetermined range of speeds, time measuring circuit means operatively connected to receive said emitted signals and the differential frequency signals passed by said filter means for measuring the elapsed time between the emitted signals and their respective differential frequency signals passed by said filter means, said measured elapsed time corresponding to the distance of the torpedo from the vessel, and electroresponsive means operatively controlled by said time measuring circuit means to ignite the propellant charge of rockets disposed within the tubes when the torpedo moves into said pattern.

4 Claims, 4 Drawing Figures

INVENTOR.
L. C. PASLAY
BY
R. M. Hicks ATTYS

INVENTOR.
L. C. PASLAY
BY
G. D. O'Brien
R. M. Hicks ATTYS

FIG. 3.
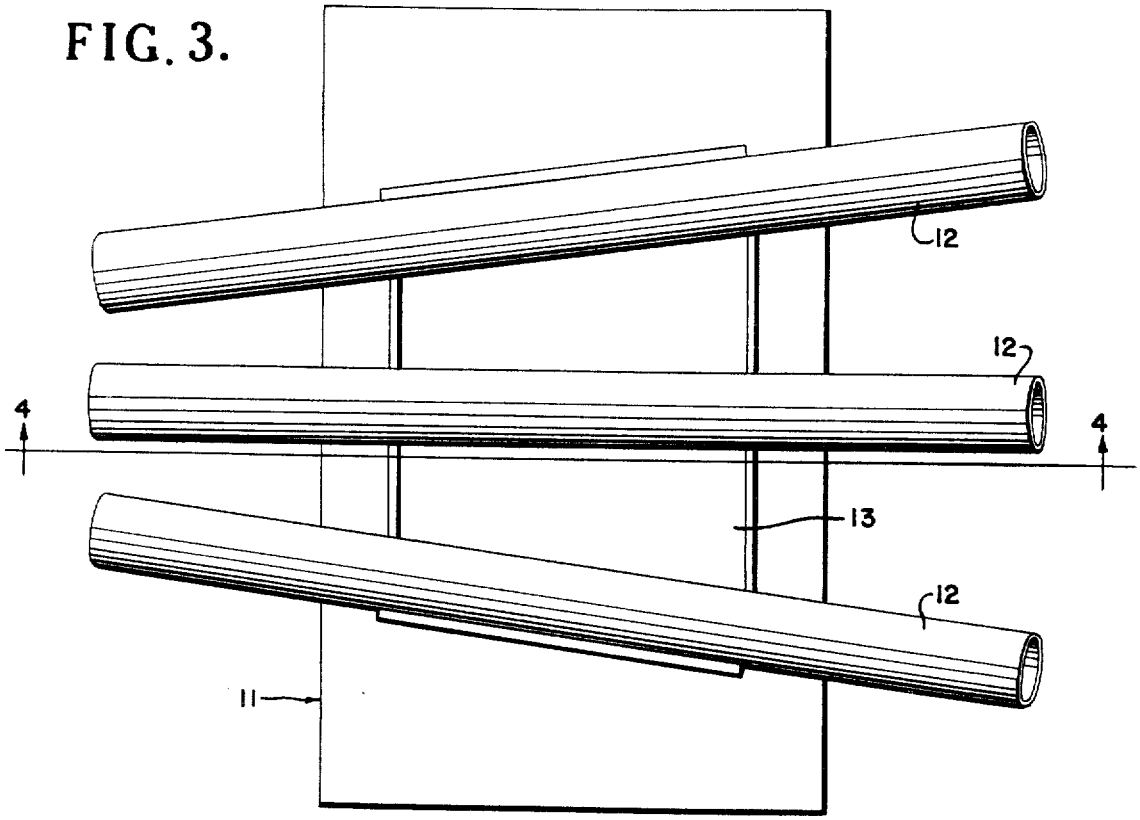
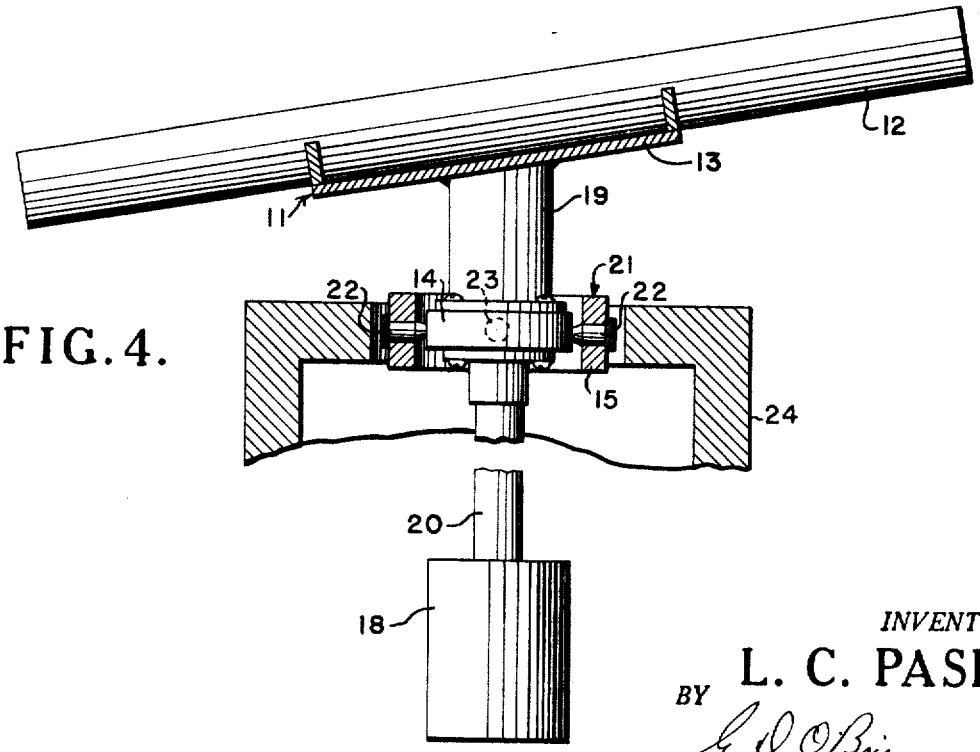
FIG. 4.
INVENTOR.
L. C. PASLAY
BY G. D. O'Brien
R. M. Hicks ATTYS

PINGING CONTROLLED ANTI-TORPEDO DEVICE

The invention described herein may be manufactured and used by or for the Government of the United States of America for governmental purposes without the payment of any royalties thereon or therefor.

This invention relates to a system and apparatus for protecting a vessel against attack from enemy underwater devices and more particularly to an apparatus of this type which is carried by the vessel for detecting the presence of an oncoming torpedo and to propel an explosive charge into the water in the path and adjacent the torpedo where the explosive charge will detonate adjacent the torpedo when the torpedo approaches to a predetermined distance from the vessel.

In anti-torpedo systems of this type heretofore devised, a plurality of flexible tubes or streamers have been towed by a moving vessel, one of such streamers being towed by the vessel and maintained at a safe distance on each side of the vessel by paravanes, the streamers being maintained at a predetermined depth beneath the surface of the water. In such a system, each streamer has arranged therein explosive charges and microphone devices disposed at intervals along the length of the streamer and operative to fire the explosive charges to thereby destroy the torpedo when the torpedo approaches within a predetermined distance of the microphones and the explosive charges. Such a device is disclosed and claimed in the copending application of Nelson N. Estes, Ser. No. 517,201 filed Jan. 6, 1944 for Anti-Torpedo System U.S. Pat. No. 2,979,015.

Such devices have not proved entirely satisfactory under all conditions of service for the reason that considerable difficulty has been experienced in streaming the apparatus from the vessel and the difficulties encountered in making replacements after the streamer has fired.

The present invention comprises a plurality of directional transducers secured to the hull on each side of the keel at spaced points along the length of the vessel and preferably such that no structure projects beyond the side of the vessel to be damaged when the vessel is warped into a pier. The transducers are arranged such that the field of transmission and response of the transducer extends outwardly from the side of the vessel and the field of response of each transducer slightly overlaps the response field of the adjacent transducer. Each transducer is intermittently connected to a source of high frequency oscillations by a ping switch to produce short bursts of high frequency energy radiating outwardly from the vessel through the water. The ping switch also provides a connection to a lapse of time measuring circuit during the transmission period which establishes a timing reference at the moment of transmission. An amplifier is also connected to the transducer to receive signals which are reflected back from the oncoming torpedo. The elapsed time between each of the transmitted and reflected signals decreases as the torpedo moves toward the transducer. Furthermore, the received signals have an apparent frequency shift in accordance with the well-known Doppler effect as a result of the relative motion between the torpedo and the transducer as the torpedo continues its run toward the vessel. The reflected signal is heterodyned with the oscillator signal at the transmitted frequency to produce a beat frequency signal. This signal is utilized to operate the lapse of time measuring circuit which, in turn, is effective to operate a relay to close a firing circuit. The firing circuit is employed to ignite a propellant charge to propel a rocket, depth charge, or the like, from the vessel and cause an explosion or series of explosions in the water and adjacent the torpedo thereby to destroy, disable or deflect the torpedo from the vessel. This occurs when the elapsed time between the transmitted and reflected signals has been reduced to a predetermined value and the beat frequency is within a predetermined range, that is, when the torpedo is moving at a velocity corresponding to this frequency range and reaches a predetermined distance from the vessel.

One of the objects of the present invention is to provide a new and improved method and apparatus for protecting a vessel against torpedo attack.

Another of the objects is to provide new and improved means for the continuous protection of a vessel against attack from torpedoes which are launches in consecutive order toward the vessel.

Another of the objects is to provide protection for a vessel against torpedo attack which will not reduce the speed of the vessel and which is unaffected by rapidly moving cross currents.

Another of the objects is to propel rockets, depth charges or the like from the vessel and into the path of an oncoming torpedo to cause detonation adjacent the torpedo in response to a signal received from the torpedo when the torpedo approaches to a predetermined distance from the vessel.

Another object is to project signals outwardly from a vessel and into the surrounding water and to propel rockets, depth charges or the like into the water and adjacent the torpedo when the elapsed time between projected signals and signals reflected from an oncoming torpedo reaches a predetermined value.

Another of the objects is to provide means for maintaining the elevation of the rocket or depth charge launcher constant regardless of pitch and roll of the vessel.

Another of the objects is to provide a firing circuit for launching rockets, depth charges or the like from the deck of a vessel into the path of an omcoming torpedo in response to Doppler signals reflected from the torpedo when the torpedo reaches a zone remote from the vessel thereby to cause an explosion within the water adjacent the torpedo sufficient to render the torpedo ineffective to damage the vessel.

Other objects and many of the attendant advantages of this invention will be readily appreciated as the same becomes better understood by reference to the following detailed description when considered in connection with the accompanying drawings wherein:

FIG. 3 is a somewhat enlarged plan view of a rocket launcher employed in the system of the present invention; and FIG. 4 is a view of the rocket launcher taken along line 4—4 of FIG. 3.

Figure 1:
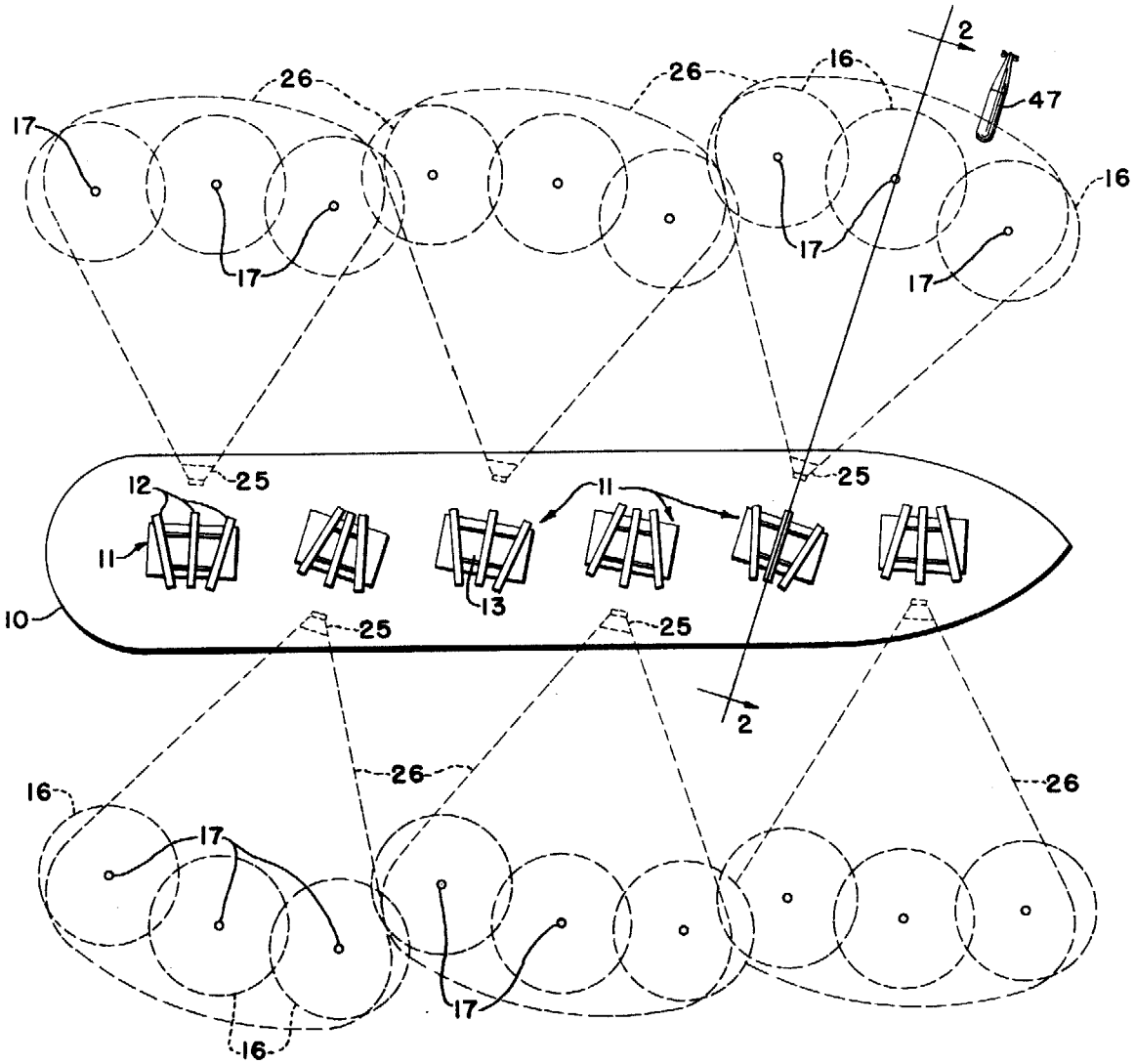
FIG. 1 is a diagrammatic plan view of a vessel illustrating the torpedo protection system of the present invention according to a preferred embodiment thereof employed for detecting and destroying an omcoming torpedo.

Referring now to the drawings in which like numerals of reference are employed to designate like parts throughout the several views and more particularly to FIG. 1 there is shown thereon a vessel 10 equipped with an anti-torpedo device of the present invention comprising a plurality of rocket launchers, generally designated 11 and arranged along the vessel at spaced intervals. Each rocket launcher 11 comprises three launching tubes 12 which are secured to and supported by support rack 13 with the axes of the right and left tubes aimed to the right and left respectively with respect to the axis of the center tube substantially as shown. The tubes 12 of each rocket launcher are arranged in a fan-like manner such that the rockets 17, when simultaneously projected from the tubes and exploded within the water, set up patterns as shown at 16 at a predetermined distance from the vessel such, for example, as 175 feet and in mutual spaced relationship. The explosion patterns 16 for all of the launcher tubes 12 have been disclosed in FIG. 1 to illustrate the destructive zones thus set up on each side of the vessel. It will be understood, however, that each destructive zone 16 occurs only when the rocket for producing it has been projected into the water and fired therewithin. It will further be understood that the individual launchers 11 project their rockets 17 into the water selectively in accordance with signals received from the oncoming torpedo indicative of the need for firing thereof to intercept the torpedo.

It has been well established that a 50 pound explosive charge detonated within a radius of 40 feet of torpedo, will render the torpedo ineffective. As will be hereinafter more fully explained, each rocket carries an explosive charge arranged to detonate in response to a predetermined depth of submersion or in response to the explosion of an adjacent rocket within the water, whichever occurs first, and thus, to form a barrage to destroy or render ineffective any torpedo within the destructive range thereof, all rockets of a particular group preferably firing simultaneously to increase the effectiveness of the barrage. The effective explosive area of each of the rockets, as aforementioned, is designated by the area enclosed by the circular dashed line 16.

Figure 2:
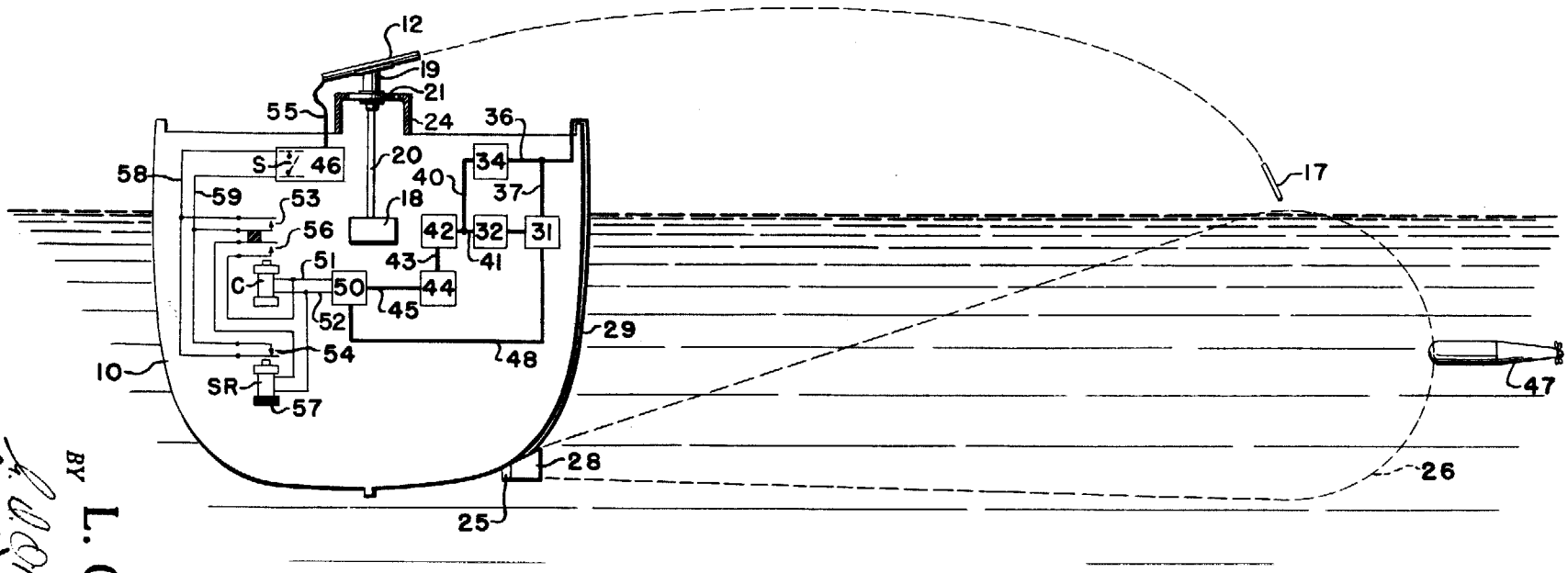
FIG. 2 is a view taken along line 2—2 of FIG. 1 and showing the firing control system of the present invention.

The support rack 13 is affixed at the upper end of a pendulum arm 19 and a weight member 18 is affixed at the lower end of a depending arm 20, FIG. 4. The pendulum arms 19 and 20 are mounted within an inner gimbals ring 14, which is pivotally supported on outer gimbals ring 15 by a pair of axially aligned pivot pins 22. The outer ring 15 is pivotally supported on cylindrical frame 24 by a pair of axially aligned pivot pins, shown by a dotted circle referenced by numeral 23, which are mounted thereon to pivotally support outer ring 15 in the same manner as pins 22 support ring 114 but disposed so that the axis thereof is coplanar with and perpendicular to the axis of pins 22 whereby the axis of oscillation of the inner gimbals ring is in the horizontal plane. The cylindrical frame 24 is secured to the deck of the vessel as shown in FIG. 2. In this manner, the pendulum arms 19 and 20 are maintained vertical by the weight 18 regardless of the oscillation of the gimbals mechanism generally designated 21. The gimbals mechanism 21 is supported preferably on the deck of the vessel with the pendulum arms 19 and 20 preferably coinciding with the longitudinal center line of the vessel when the vessel is on an even keel. By reason of this novel arrangement, each of the launching tubes 12 is maintained substantially at a fixed elevation with respect to the surface of the water as the ship rolls and pitches which results in maintaining the range of the rockets substantially constant in order that the rockets will enter the water at a predetermined distance from the vessel. It will, of course, be understood that the range of the rockets is determined, within certain limits, by the angle of elevation of the launching tubes 12 and the impelling force of the propellant charge disposed within the rockets.

The rockets or depth charges are of the type in which means are provided for causing detonation thereof at a predetermined depth of submergence such, for example, as 40 feet. Any mechanism suitable for this purpose may be employed for detonating the rockets at a predetermined depth such, for example, as the mechanism disclosed in U.S. Pat. No. 1,368,569 issued to Chester T. Minkler, Feb. 15, 1921, for Hydrostatic Mine.

In order to ignite the propellant charge of the rocket at the proper time to project a rocket from its respective launching tube 12 into the path of the oncoming torpedo and adjacent thereto when the torpedo approaches within a predetermined distance from the side of the vessel, a circuit diagrammatically shown in FIG. 2 is provided which operates to ignite the propellant charge of the rocket when sound waves initiated by a sound emitting device on the vessel and impinging on the casing of a torpedo are refected back to the sound emitting device (which now operates as a microphone) after a predetermined interval corresponding to a predetermined distance between the torpedo and the vessel. A circuit well suited for use in connection with the present invention is schematically illustrated in FIG. 2.

The sound emitting and receiving device preferably comprises a magnetostrictive or crystal transducer 25 secured below the water-line to the hull of the vessel and having a flexible water-tight diaphragm 28 secured thereto. The transducer 25 is of the type having a useful directional broadcast and pick-up field of response designated by the dashed line 26 which forms a directional field pattern of response within the water extending outwardly from the side of the vessel. As shown by the dotted lines 26 in FIG. 1, the directional broadcast field of each transducer is a broad fan-like directional beam which overlaps the directional beams of adjacent transducers located on the same side of the vessel, thereby presenting an unbroken signal wave front through which no oncoming torpedo can pass undetected while the detecting system is in operation. A waterproof cable 29 comprises a conductor path 37 which forms an electrical connection from the speaker 25 through ping switch 31 to oscillator 32, FIG. 2. The oscillator 32 is adapted to intermittently energize the transducer 25 by means of ping switch 31 to broadcast a high frequency square wave pulse signal such, for example, as 20 K. C. into the water in a pattern as shown at 26, the repetition rate being controlled by the ping switch to have a time interval sufficient for the maximum range of detection desired. Also connected to the transducer 25 by conductors 29 and 36 is amplifier 34.

Intermediate the sound emitting intervals, the amplifier 34 receives a signal when the echo or reflected sound from the torpedo energizes the speaker 25 with a reflected signal. The oscillator 32 and amplifier 34 are connected by conductors 40 and 41 respectively to a heterodyne detector 42 which passes the received signals from the amplifier 34 in the form of a beat frequency signal by way of conductor path 43 to the filter 44. These beat signals will have sum and difference components due to the difference between the frequency of oscillator 32 and the frequency of the received signals. For a moving target, the received signals will have a frequency different from that of the oscillator 32 due to the Doppler shift aforesaid and the frequency of the difference signal supplied to filter 44 will depend on the relative speed of the torpedo with respect to the vessel.

The range of beat frequencies which will be encountered can be determined from known data regarding the speed of torpedoes, and filter 44 can be designed to pass only those frequencies which will result from a moving torpedo. The filter 44 operates to filter out or reject all frequencies above or below this band of predetermined frequencies such, for example, as frequencies less than 50 cycles per second and frequencies greater than 500 cycles per second. The filter 44 is operatively connected by way of conductor path 45 with a lapse of time measuring circuit 50 for controlling the operation of a firing circuit, generally designated 46, by means of control relay C and the slow release relay SR. The firing circuit is operated when signals are received by the timing circuit 50 via conductor path 45 a predetermined time after the transmission ping signal is received thereby via conductor 48, it being understood that the ping switch includes means for disconnecting conductor 48 from the oscillator and the transducer concurrently with the disconnecting of the oscillator from the transducer. This predetermined time corresponds to the interval required for the transmitted wave to travel to the torpedo and back to the hydrophone when the torpedo is for example, 225 feet athwartship and in the vicinity of where the rockets will enter the water such as, for example, 175 feet athwartship.

This firing control operation may be accomplished, for example, when timing circuit 50 is of the same general type as that disclosed in the copending application of Ford L. Johnson et al. for Distance Measuring Apparatus, Ser. No. 657,310, filed Mar. 26, 1946, wherein the average value of current, which is caused to flow during the interval between the transmitted and received pulses, is taken as a measure of the distance between the transmitting body and the reflecting surface. In such an arrangement, a control relay C is used in lieu of ammeter 169 of the circuit of the aforesaid copending application of F. L. Johnson et al., relay C being of a suitable type adapted to release when the average value of current supplied thereto from circuit 50 has decreased to a predetermined value corresponding to a distance of the torpedo from the vessel at which it is desired to fire the rocket.

Relay C has a pair of make contacts 53 which are connected in parallel with the pair of break contacts 54 of the relay SR and across the opened manually operable switch S of the firing control circuit 46 by means of leads 58 and 59. This circuit 46 is preferably of the type disclosed in the copending application of Edward A. Gaugler, Ser. No. 56,601, filed Oct. 26, 1948 for Induction Firing Device for a Rocket Motor wherein the switch S is initially closed and a firing pulse is supplied by way of conductor path 55 to a primary induction coil disposed adjacent the rocket launching tube 12 when the switch S is momentarily opened. The energy in the primary coil is transferred inductively to a secondary coil carried by the rocket and is utilized to fire the rocket propellant charge.

For purposes of the present invention switch S is not used and is retained in an open position, the function of the switch being supplied by reay switches 53 and 54. Switch 54 initially closes the circuit across switch S, and this condition is additionally provided by switch 53 as relay C operates in response to current received via conductors 51 and 52 from circuit 50. As relay C operates, a second pair of contacts 56 thereof are closed after contacts 53 close and complete a circuit for energizing relay SR from circuit 50. As relay SR operates, switch 54 opens, the circuit across switch S being maintained closed by switch 53 until the current from circuit 50 drops to the predetermined value aforesaid. Relay SR has a lower drop-out current than relay C and has a slow release time provided by copper slub 57 whereby switch 53 opens before switch 54 closes upon opening of switch 56 as relay C releases, firing circuit 46 thus being operated as switch 53 opens.

Alternatively, timing circuit 50 could be a combination of a delayed gate pulse generator and a type of circuit well known in the art as a coincidence circuit. The coincidence circuit is provided with two inputs and an output and has the characteristic of producing no output signal unless the two inputs receive signals simultaneously. To be used in the present invention, one input of the coincidence circuit would be supplied with a delayed enabling gate pulse generated by the generator in response to the transmitted ping received thereby via conductor path 48 and occurring a predetermined time after the ping, this time corresponding to the predetermined distance at which it is desired to intercept the oncoming torpedo. The coincidence circuit is ready to produce an output if the second input thereof connected to conductor path 45 receives a signal during the existence of the gate pulse. Thus, when the torpedo has a speed providing the correct Doppler to produce a signal at conductor path 45 and that signal occurs at the predetermined time after the transmitter ping, i.e., the time of the generated gate pulse, the two inputs of the coincidence circuit are simultaneously energized and an output signal is produced at conductors 51 and 52. This output signal in turn can be used to momentarily energize both relays C and SR. The sequence of operation of these relays will then be the same as hereinbefore described, the only difference being that the current supplied by the coincidence output signal will cease in both relays at the same time. Relay C will still drop out first because of the delayed drop out of relay SR thereby providing the same sequence of opening of switch 53 before closing switch 54 aforesaid, whereby firing circuit 46 is actuated.

Of course, the output pulse of the coincidence circuit could also be used directly to supply the control gap breakdown voltage to trigger the gas tube circuit disclosed in the aforesaid copending application of E. A. Gaugler in a manner which is well known to those skilled in the art.

Thus the firing circuit will energize an electroresponsive squib of the rocket thereby to initiate the ignition of the rocket motors of the three rockets in the launching tubes 12 at the proper moment to permit the rockets to encounter the oncoming torpedo. It will be noted that the conductors are shown in the circuits as a single line or path.

The operation of the anti-torpedo device of the present invention will now be described.

The oscillator 32 operates to energize the transducer 25 to broadcast a high frequency square wave impulse signal into the water in a pattern enclosed within the dashed line 26, the impulse signal repetition rate being controlled by the ping switch 31 and adjusted to have a time interval corresponding to the maximum range of detection to be employed. As the sound reaches the oncoming torpedo 47 it is echoed back from the torpedo to the transducer. If a sound wave is reflected from torpedo 47 during the listening interval between two such signals, the sound is amplified by 34. When the amplified signal of proper frequency corresponding to the relative velocity of the torpedo with respect to the transducer is received, the detector 42 passes the received signals through the filter 44. These signals operate the firing circuit 46 when the reflected signals occur at the predetermined time interval after the transmitted impulse corresponding to a distance in excess of the desired distance of intercepting the torpedo. As the firing circuit 46 operates, the rockets in the tubes 12 connected to the transducer individual thereto, project the rockets from the tubes to strike the water at a distance of, say, 175 feet from the side of the vessel into the path of the oncoming torpedo.

As the rockets sink within the water, the rocket detonating device operates to detonate the explosive charge when the rocket reaches the predetermined depth of submergence which will successfully render any torpedo within a radius of 40 feet ineffective to destroy the vessel. It will be understood that the detonating device of the rocket is so constructed and arranged that the detonation of one rocket will cause simultaneous detonation of the adjacent rockets so that the three rockets provide an overlapping barrage which is effective to destroy any underwater ordnance device within a range of 40 feet of any rocket.

Whereas the system has been described in particularity with reference to three rocket launchers and three underwater transducers respectively associated therewith for protecting one side of the vessel and a like number of rocket launchers and transducers for protecting the opposite side of the vessel from torpedo attack, it will be understood that this has been done for the purpose of description and that, if desired, a greater or lesser number of rocket launchers and transducers may be employed for this purpose. Furthermore, if desired, the rocket launchers may be arranged in two rows respectively along the sides of the vessel in lieu of the single line arrangement of rocket launchers disclosed on the drawings. Also, if desired, the number of rocket launchers on each rocket turret may be increased or decreased and the angle of elevation of each of the launchers may be varied to effect a desired explosive zone within the water as the rockets explode. It should also be understood that the transducers of the present invention have a response pattern which is directional in character and that the response patterns of these transducers as shown on FIG. 1 for the purpose of illustration may differ from the actual response patterns of the hydrophones or transducers under the actual conditions of service.

Regardless of the actual shape of these response patterns, it is an important feature of the invention that the patterns of the transducers disposed along one side of the vessel overlap whereby there is no possibility of a torpedo passing between the response areas of a pair of adjacent transducers without causing the operation of the system. Furthermore, the angle between the center line of each of the response patterns and the vessel may be varied at will, it being merely necessary to maintain the response patterns of the transducers in overlapping relation and to adjust the settings of the rocket turrets such that the composite explosive zone of the rockets fired therefrom is substantially symmetrically disposed with respect to the response pattern of the associated transducer and falls within the response pattern and the explosive zones are adapted to form a continuous barrage along the sides of the vessel sufficient to prevent a torpedo passing through the barrage.

Obviously many modifications and variations of the present invention are possible in the light of the above teachings. For example, it will be understood that, when desired, filters which are sharply tuned to the Doppler frequencies above the transmitted frequencies may be employed in lieu of detector 42 and filter 44. Moreover, it may be desired under certain conditions to cause pinging operation of the transducers 25 only when a torpedo has been first detected thereby in response to sound received directly from the torpedo, the sound received by the transducer closest to the torpedo having the greatest intensity and relay circuit means, for example, responsive to sound of this greatest intensity being employed to connect this transducer for pinging operation. It is therefore to be understood that within the scope of the appended claims the invention may be practiced otherwise than as specifically described.

What is claimed as new and desired to be secured by Letters Patent of the United States is:

1. A system of the character disclosed for protecting a vessel against torpedo attack comprising a gimbals mechanism including an outer ring pivotally secured to said vessel and an inner ring pivotally secured to the outer ring with the axis of oscillation of the inner ring arranged in a horizontal plane, a pendulum device secured to said inner ring and having the axis of oscillation thereof arranged in registry with a vertical plane through the keel of the vessel when the vessel is on an even keel, a plurality of rocket tubes, means for securing said rocket tubes to said pendulum device in spaced relation with respect to each other and with the longitudinal axes of the tubes arranged at the same predetermined elevation when the vessel is on an even keel whereby rockets projected from said tubes will have substantially the same predetermined fixed range as the vessel rolls and pitches, said rocket tubes also having a divergent angular setting with respect to each other such that rockets projected therefrom will strike the surface of the water to form an overlapping explosive pattern at said predetermined fixed range of sufficient explosive force to destroy an oncoming torpedo within said pattern when the rockets are detonated, a directional sound emitting and echo detecting means arranged on the vessel with the field of sound emission and detection thereof projecting outwardly from the side of the vessel, said emitting and detecting means emitting sound signals into the water in the path of travel of said oncoming torpedo and thereafter receiving the reflected signals therefrom, heterodyne means for beating the reflected sound signals with the emitted sound signals to derive differential frequency signals representative of the speed of the oncoming torpedo, filter means responsive to the output of said heterodyne means for passing only differential frequency signals representative of a predetermined range of speeds, time measuring circuit means operatively connected to receive said emitted signals and the differential frequency signals passed by said filter means for measuring the elapsed time between the emitted signals and their respective differential frequency signals passed by said filter means, said measured elapsed time corresponding to the distance of the torpedo from the vessel, and electroresponsive means operatively controlled by said time measuring circuit means to ignite the propellant charge of rockets disposed within the tubes when the torpedo moves into said pattern.

2. In a device of the character disclosed for igniting a propellant charge of an ordnance device when an oncoming torpedo reaches a predetermined distance from a vessel comprising, a casing secured to the keel of the vessel, a transducer enclosed within said casing and including a flexible diaphragm in communication with the surrounding water for transmitting sound waves toward the torpedo and for receiving the reflected sound waves therefrom, means for measuring the elapsed time between the transmitted waves and the reception of the reflected waves from said torpedo and corresponding to the distance of the torpedo from the vessel, said means including a detector for beating the reflected sound waves with the transmitted sound waves to derive differential frequency signals which are proportional to the speed of the oncoming torpedo and time measuring circuit means which is responsive to transmitted sound waves and only to derived differential frequency signals representative of a predetermined range of speeds for developing electrical characteristics correlative to the elapsed time between the transmitted sound waves and their respective differential frequency signals within said predetermined range of speeds, and means responsive to said electrical characteristics for igniting said propellant charge when said measured elapsed time corresponds to said predetermined distance.

3. A system of the character disclosed for protecting a vessel against attack from an oncoming torpedo comprising a gimbals mechanism including an outer ring horizontally pivoted on the vessel and an inner ring pivotally secured to the outer ring, a pendulum device in registry with the vertical plane through the keel of the vessel and secured to the inner ring, a plurality of rocket launching tubes secured to said pendulum device with the tubes elevated and trained with respect to each other to project negatively buoyant rockets therefrom at a predetermined range from the side of the vessel, each of said tubes being spaced at a predetermined distance with respect to the adjacent rocket tube, said rockets being projected into the path of an oncoming torpedo when the torpedo is detected, each of said rockets having a pressure responsive device therein adapted to detonate the rocket and the adjacent rocket thereto when the rockets simultaneously sink to a predetermined depth beneath the surface of the water for forming an overlapping destructive zone sufficient to destroy a torpedo within said zone, a directional sound emitting and echo detecting means arranged on the vessel and having the sound emission and detection field thereof projecting into said destructive zone, said emitting and detecting means being adapted to emit sound signals toward said torpedo and thereafter receive the echoed signals therefrom, circuit means operatively connected to said sound emitting and echo detecting means for measuring the elapsed time between the emitted and echoed signals and corresponding to the distance of the torpedo from the vessel, said circuit means including a detector for beating the received echoed signals with the emitted sound signals to derive differential frequency signals which are proportional to the speed of the oncoming torpedo and time measuring circuit means which is responsive to the emitted sound signals and only to derived differential frequency signals representative of a predetermined range of speeds for developing variable electrical characteristics correlative to the elapsed time between the emitted sound signals and their respective differential frequency signals within said predetermined range of speeds, and means operatively connected to receive said electrical characteristics for igniting the propellant charge of the rockets when an electrical characteristic, indicative of an oncoming torpedo entering said destructive zone, is received thereby.

4. An explosive moving object detection and destruction system for protecting a vessel comprising, in combination, a plurality of missile propelling devices having means for maintaining the firing range thereof substantially fixed at a predetermined distance from the vessel, a signal source for each of said devices for producing a high frequency signal, a transducer for each signal source operatively connected to its respective signal source to radiate said frequency signals in broad fan-like directional beam, the transducers being arranged on the vessel so that the beams of adjacent transducers overlap thereby presenting an unbroken signal wave front through which no explosive moving object may pass undetected, said transducers being intermittently enabled to alternately radiate said signal and receive echo signals reflected from an explosive moving object, detecting means for each transducer and coupled to its respective transducer and signal source for beating the received echo signals with said high frequency signal to derive a differential signal corresponding to the speed of the explosive moving object, time measuring circuit means for each transducer coupled to receive said high frequency signal at the instants of radiation thereof and being of such character as to receive only differential frequency signals representative of a predetermined range of speeds of moving objects, said measuring circuit means being operable in response to said received high frequency and differential frequency signals to develop electrical characteristics indicative of the elapsed time intervals between the instants of radiations of the high frequency signal and the reception of the respective echo signal, said measured elapsed time intervals corresponding to approaching distances of the moving objects from the vessel, and electroresponsive means for each transducer coupled to the output of its respective time measuring circuit and operatively connected to its respective one of said devices to propel the missiles of its respective one of said devices when the moving object is measured to be substantially at a distance as to be intercepted at said predetermined distance by the propelled missiles.

* * * * *